United States Patent [19]

Crookston

[11] Patent Number: 4,809,436

[45] Date of Patent: Mar. 7, 1989

[54] SHINGLE STRIPPING TOOL

[76] Inventor: James R. Crookston, 3566 Oak Rd., Stow, Ohio 44224

[21] Appl. No.: 6,169

[22] Filed: Jan. 23, 1987

[51] Int. Cl.[4] ..... B26B 3/00

[52] U.S. Cl. ..... 30/171; 254/131.5

[58] Field of Search ..... 30/171, 172, 169; 254/131.5

[56] References Cited

U.S. PATENT DOCUMENTS 4,086,699 5/1978 Olkkola ..... 30/172

4,477,972 10/1984 Testa, Jr. ..... 30/172

*Primary Examiner*—Frank T. Yost

*Assistant Examiner*—Willmon Fridie, Jr.

*Attorney, Agent, or Firm*—Oldham & Oldham Co.

[57] ABSTRACT

A roofer's tool for stripping shingles from the roof of a building; the tool including a blade attached to a straight handle by a mounting bracket whereas the mounting bracket includes a section attached to the end of the handle and a fulcrum portion extending backwardly from the handle while a flat attaching section protrudes forwardly from the lower end of the handle and where the blade has a row of operative teeth along a front edge thereof whereby the tool can be manually forced under a layer of shingles and an effective prying action upwardly on the shingles from their lower surfaces can be provided by pivoting the tool around a fulcrum section of the mounting bracket. Also the blade is removably attached to a portion of the mounting bracket by mounting members which are readily accessible and are protected against damage in use of the tool.

3 Claims, 2 Drawing Sheets

SHINGLE STRIPPING TOOL

BACKGROUND ART

This invention relates to the problems encountered by roofers when it is necessary to strip a layer of shingles from a roof prior to other treatment of the roof, such as applying a new layer of shingles thereto. These shingles must be removed in many instances and the shingles are not going to be re-used but are going to be scrapped whereby an inexpensive, more convenient method of removal of the shingles is desired.

Some tools have been proposed heretofore including a tool shown in U.S. Pat. No. 4,086,699 wherein a shingle removing metal head member is operatively attached to an elongate handle and wherein the shingle removing member has a row of teeth at a front edge thereof. Such a tool gives some good operative characteristics, but the shingle engaging, prying or removal action of the tool does damage the metal shingle engaging head of the tool, or the teeth forming the nail engaging portion of the shingles can be damaged or impaired by use so tool repair is required. The entire tool normally would be discarded as the tool would be practically non-repairable. Furthermore, the prior tool is believed to have a poor fulcrum portion, which is not of a sturdy, dependable construction for long service life.

The general object of the present invention is to provide a new and improved roofer's tool for stripping shingles from a roof and characterized by the sturdiness of the tool and its adaptability ability to provide a long service line.

Another object of the invention is to provide a shingle stripping tool for roofers wherein an operable blade portion of the tool is removable attached to the remainder of the tool and a new blade portion for the tool can be readily engaged with the tool when needed.

Yet another object of the invention is to provide a sturdy fulcrum portion in a tool used for stripping shingles from a roof and to facilitate the prying action for loosening shingles from a roof.

Yet another object of the invention is to mount a shingle stripper plate in a novel manner on a shingle removing tool, and to provide a protected attaching means for positioning the stripper plate in the tool and furthermore to provide an effective sturdy fulcrum in a roofer's tool and to form a sturdy fulcrum for the tool adapted to resist the rough, abrasive action to which the tool will be subjected in use.

The foregoing and other objects and advantages of the invention will be made more apparent as the specification proceeds.

BRIEF DESCRIPTION OF THE DRAWINGS

For a better understanding of the invention, attention is directed to the accompanying drawings wherein.

When referring to corresponding portions or members referred to in the specification and shown in the drawings, corresponding numerals are used to facilitate comparison therebetween.

BEST MODE FOR CARRYING OUT INVENTION

Figure 2:
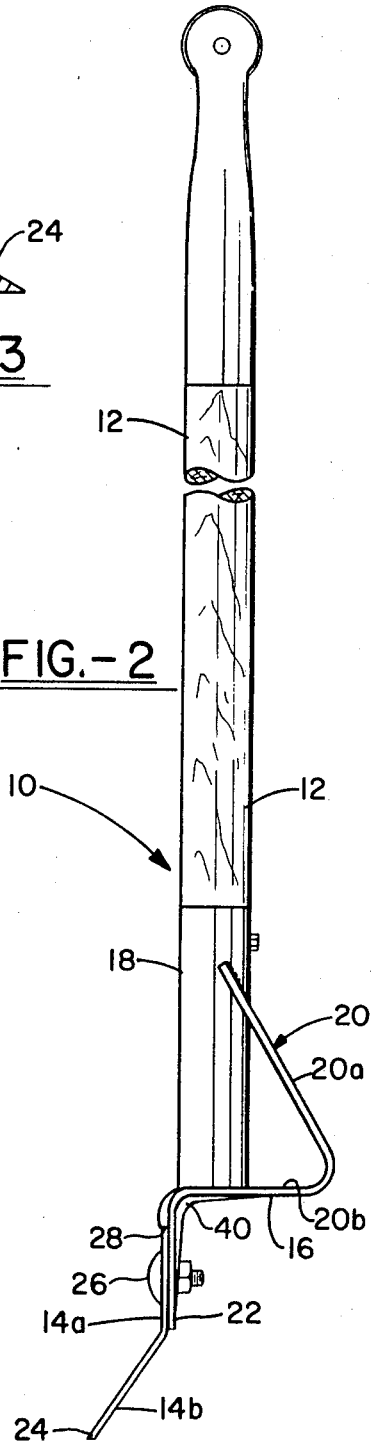
FIG. 2 is a fragmentary side elevation of the tool of FIG. 1.

Attention particularly is now directed to the details of the structure shown in the accompanying drawings, and a roofer's tool, or a shingle stripping tool is indicted as a whole by the numeral 10. This tool 10 incudes a handle 12 and a blade 14. The blade 14 is secured to the handle by means of a mounting bracket 16 when also provides an effective fulcrum portion for the handle in its manual operative use. The drawing clearly shows that the mounting bracket 16 includes a tubular section 18 which engages the lower end of the handle 12 and a fulcrum portion 20 which extends rearwardly of the tool and handle and then forwardly of the tool 10 by sections **20*a* and 20*b* respectively. The fulcrum portion also includes a front portion that is downwardly extending as indicated at 22 which front portion 22 is flat and extends substantially parallel to a longitudinal axis of the handle. The front portion 22 underlies a rear portion 14*a* of the blade 14, which also has a front portion 14*b* that in FIG. 2, for example, is shown to extend downwardly and forwardly in relation to the longitudinal axis of the tool. The rear portion 14*a* of the blade lies over and against the front portion 22 of the fulcrum 20 of the mounting bracket 16**.

Figure 4:
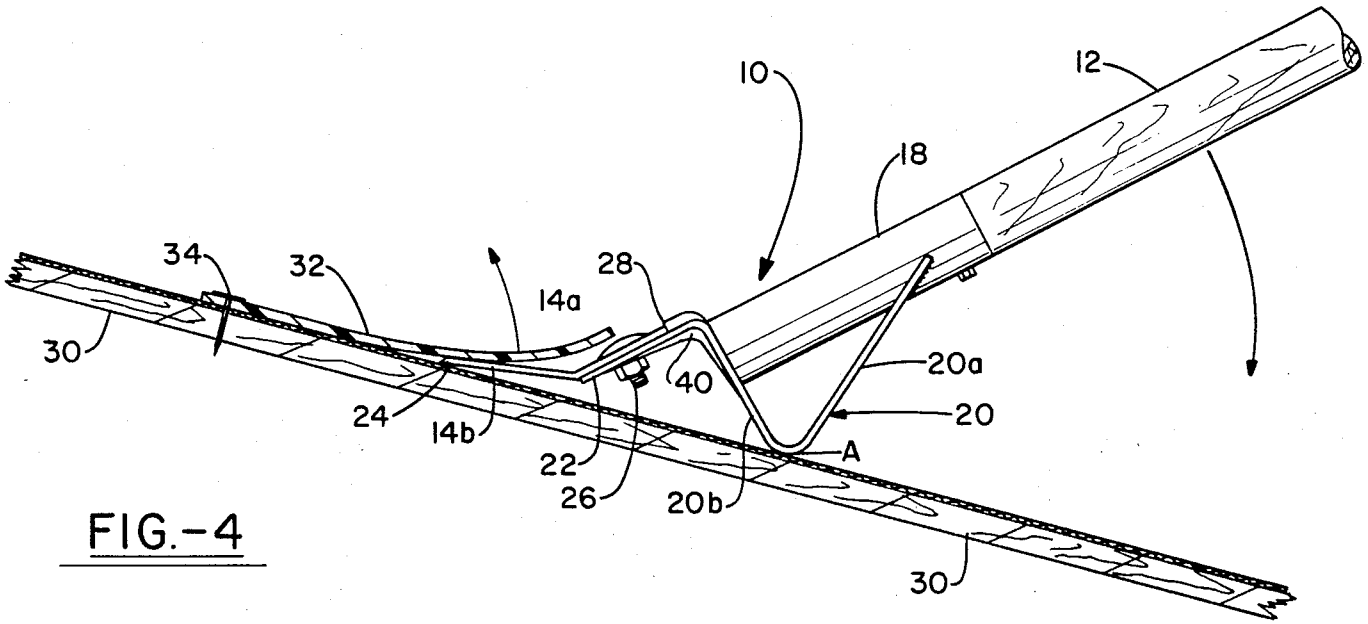
FIG. 4 is a fragmentary sectional view showing the tool of the invention in operative engagement with the shingle for removing it from a roof structure.

The drawings show that it is a feature of the tool of the invention that the fulcrum portion 20 is made from a sturdy metal plate or sheet and it is more or less of a V-shape that engages the tubular portion 18 and is welded thereto or formed therewith but extends downwardly and rearwardly therefrom whereby the actual fulcrum point A of the tool is spaced rearwardly of the tool an appreciable distance. Also, it should be seen that the fulcrum portion is so constructed and arranged that the point A is spaced appreciably from the axis of the handle and rearwardly therefrom. Thus, by the blade 14 and its particular shape in relation to the fulcrum, there is provided a sizable opening or space at the back portion of the front section or part 22 of the fulcrum of the mounting bracket. Thus, a rather protected area is provided in the tool in relation to its operative position in relation to a roof 30 shown in FIG. 4 when the tool is being used to remove or loosen shingles from this roof. Such shingles 32 can be pried upwardly from the roof and the blade can even be worked in under the nails 34 holding the shingle 32 in place in many instances. In all events, when the tool 10 is operatively positioned as shown in FIG. 4, then by prying downwardly on the tool handle 12 the shingles are moved upwardly and continued movement of the blade 14 upwardly under the shingles facilitates complete release of the shingles from the roof.

It is a feature of the invention that the blade 14 can be removed from the tool 10 when it becomes dulled or otherwise impaired in functioning ability. The blade 14 in the front portion **14*b* thereof has a series of teeth 24 spaced laterally of the front edge of the blade. These teeth can be provided with beveled edges if desired and the ends may be slightly blunt or pointed as desired. The blade 14 is held in place by connection means, such as round head bolts 26, a pair of which extend through the rear portion of the blade and through the front or flat portion of the fulcrum member of the tool. FIG. 4** shows that, in operation, these bolts and even the inner ends thereof are not exposed to direct physical abuse or contact with the work in progress and the blade is thus readily removable from the tool when replacement is required or if the teeth of the blade need sharpening, etc.

So as to position the blade 14 accurately on the tool, preferably a pair of laterally spaced shoulders or abutments 28 are provided on the front portion 22 of the fulcrum section of the mounting bracket. Such abutments are provided so that the rear edge of the rear portion 14*a* of the blade can be abutted thereagainst the align and position the blade since the abutments extend upwardly from the front portion of the fulcrum part of the tool.

The blade 14 is made of high grade carbon steel to provide a longer wear life; and, by making the blade readily removable, its replacement, when needed, is possible.

Figure 1:
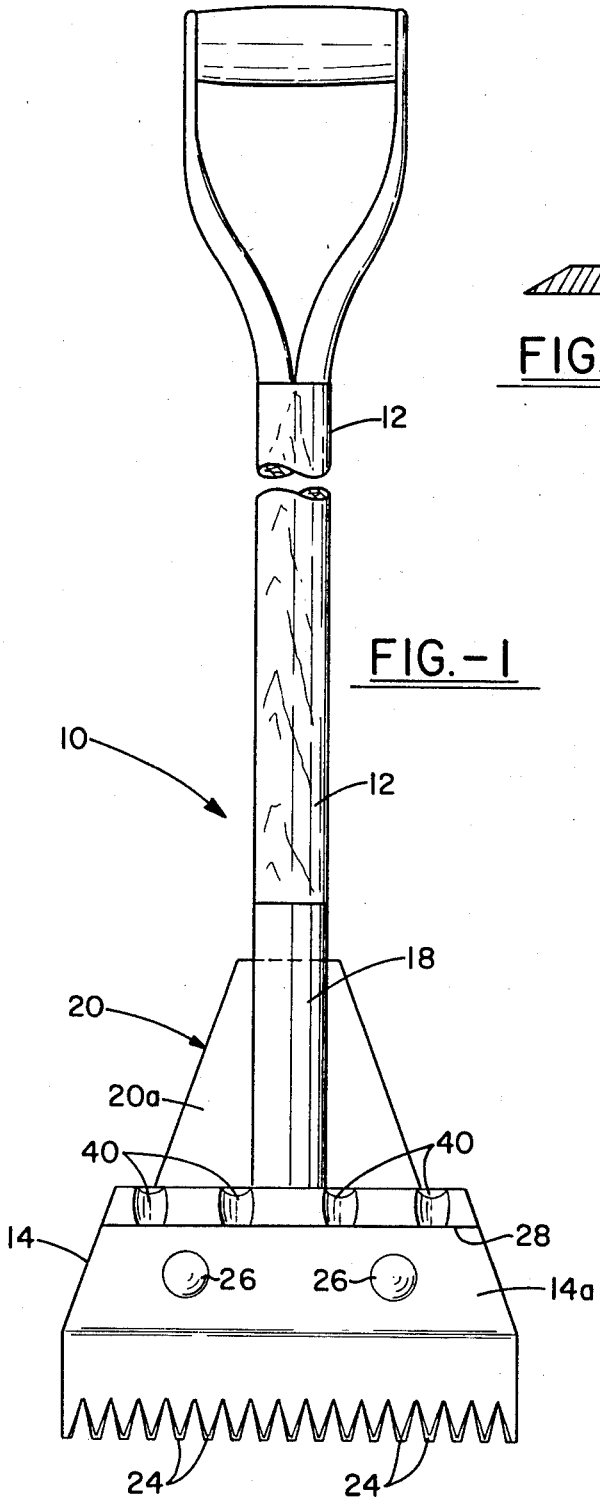
FIG. 1 is an elevation, partially broken away, of a roofer's tool for stripping shingle and embodying the principles of the invention.
Figure 3:
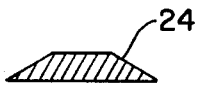
FIG. 3 is an enlarged sectional elevation through a tooth of the tool of FIG. 1.

FIG. 1 of the drawings brings out the fact that the fulcrum portion 20 of the tool is wider than the handle and extends out laterally from it as it protrudes rearwardly from the tubular section 18 to provide a sturdy, good operative fulcrum for the tool and enable it to stand rough usage but still have an effective, long operative life.

The strength of the tool is improved by a plurality of laterally spaced reinforcing gussets 40 formed in the fulcrum portion 20 of the tool, and extending downwardly of the tool. The reinforcing gussets 40 extend downwardly and rearwardly of the front portion 22 of the mounting bracket to reinforce the mounting bracket at the angular connection of the bracket section 20*b* and the rear end of the bracket front portion 22. Such gussets 40 have the forwardly extending elevated shoulders 28 formed therebetween.

It is believed that the objects of the invention are achieved and that an improved, sturdy tool is provided that can be readily maintained and the teeth of this tool that engage the shingle for removal can be replaced when a new blade would be required after some appreciable service of the tool.

While in accordance with the patent statutes, a preferred embodiment and best mode has been presented, the scope of the invention is not limited thereto, but rather is measured by the scope of the attached claims.

What is claimed is:

1. A roofer's tool for stripping shingles from the roof of a building and comprising:

a blade, a straight handle for the blade, and a mounting bracket for attaching the blade to the handle;

the mounting bracket including a section attached to the lower end of the handle and having a fulcrum portion extending in one direction from the handle, and a flat mounting section protruding beyond the lower end of the handle substantially parallel to the axis of the handle, said blade including a flat section having a row of laterally spaced teeth at its forward edge and having an upwardly inclined flat rear section overlapping the attaching section, and means securing the blade to the mounting bracket to enable the row of teeth and the flat section to be inserted between the roof and a shingle to be pried up when the handle is pivoted downwardly, said blade and said flat mounting section of said mounting bracket forming a smooth upper surface for the tool, which upper surface blends smoothly with the axis of the handle to present no obstruction to work products moving over said upper surface and up along said handle.

2. A roofing tool as in claim 1 where said fulcrum section and said front section of said fulcrum section are sized to space said front section from the roof in use of the tool to form a protective pocket at the back of said front section.

3. A roofing tool as in claim 1 where a plurality of laterally spaced alignment means are provided in the mounting bracket at a rear portion of the flat attaching section and they engage a rear edge of said blade when said blade is operatively positioned and reinforcing gussets are formed in the mounting bracket in substantial alignment with said alignment means in the mounting bracket.

* * * * *